US006976898B2

(12) United States Patent
Hitzschke et al.

(10) Patent No.: US 6,976,898 B2
(45) Date of Patent: Dec. 20, 2005

(54) METHOD FOR PRODUCING A SILENT FLAT RADIATOR BY SOFTENING A LIMITED NUMBER OF SUPPORTS

(75) Inventors: Lothar Hitzschke, Munich (DE); Frank Vollkommer, Buchendorf (DE)

(73) Assignee: Patent-Treuhand-Gesellschaft fuer Elektrische Gluehlampen mbH, Munich (DE)

( * ) Notice: Subject to any disclaimer, the term of this patent is extended or adjusted under 35 U.S.C. 154(b) by 268 days.

(21) Appl. No.: 10/398,661

(22) PCT Filed: Jun. 26, 2002

(86) PCT No.: PCT/DE02/02341

§ 371 (c)(1),
(2), (4) Date: Apr. 8, 2003

(87) PCT Pub. No.: WO03/017321

PCT Pub. Date: Feb. 27, 2003

(65) Prior Publication Data

US 2004/0033751 A1 Feb. 19, 2004

(30) Foreign Application Priority Data

Aug. 8, 2001 (DE) ..... 101 38 924

(51) Int. Cl.[7] ..... H01J 9/00; H01J 9/24
(52) U.S. Cl. ..... 445/25; 445/40
(58) Field of Search ..... 445/25, 26, 40, 445/43

(56) References Cited

FOREIGN PATENT DOCUMENTS

| | | |
|---|---|---|
| DE | 198 17 478 | 4/1998 |
| DE | 100 06 750 | 2/2000 |
| DE | 100 48 186 | 9/2000 |
| DE | 100 48 187 | 9/2000 |

*Primary Examiner*—Joseph Williams
(74) *Attorney, Agent, or Firm*—Robert F. Clark

(57) ABSTRACT

The invention relates to an improved method of production for a flat radiator discharge lamp designed for dielectrically impeded discharges, in which, during a filling step for the discharge vessel, a plate of the discharge vessel is jacked up on parts, later softening, of support elements in order to be lowered onto the other plate at a specific temperature. In this case, the support elements serve, in addition, to improve the mechanical stability of the finished flat radiator. According to the invention, only a small number of the support elements present in a relatively large number are used for the outlined function of holding up the plate.

12 Claims, 2 Drawing Sheets

METHOD FOR PRODUCING A SILENT FLAT RADIATOR BY SOFTENING A LIMITED NUMBER OF SUPPORTS

TECHNICAL FIELD

The present invention relates to a method for producing a flat radiator that is designed for dielectrically impeded discharges. A flat radiator is a discharge lamp in a flat design.

PRIOR ART

Such discharge lamps are prior art per se. They regularly have a discharge vessel for holding a discharge medium, frequently Xe. Furthermore, an electrode set is provided that is separated at least partially from the discharge medium by a dielectric layer such that dielectrically impeded discharges can be produced in the discharge medium.

The flat radiator design of such discharge lamps is also previously known per se. The discharge vessel of such flat radiators has a base plate and a top plate that are connected by a frame, running in the region of the outer edge of the plates, such that a discharge space for the discharge medium is bound in between the plates. The electrode set can be arranged in this case on the inner side of one plate or the plates, or else on an outer side of the discharge vessel, or distributed over various such positions. Furthermore, the frame can also be a component of one of the plates.

It is also known in the case of flat radiators to provide support elements inside the frame between the plates that shorten the effective bending lengths and thereby improve or ensure the mechanical stability of the discharge vessel. This aspect is significant chiefly when the flat radiators are operated with the aid of an underpressurized discharge medium and/or when the flat radiator is one of large format. It is to be taken into account in this case that flat radiators can be used, in particular, for backlighting flat display devices in the case of which there is a need for relatively large formats with homogenous backlighting that is uninterrupted as far as possible.

Finally, it is known from DE 198 17 478 for these support elements to be configured in a particular way, specifically to be provided with a part that softens at the temperature of a filling step. The filling step can be executed, for example, in a vacuum furnace, and takes place at a raised temperature in order to drive off adsorbates on the discharge vessel inner walls and/or in order to render possible softening of the abovementioned parts of the support elements. Moreover, in accordance with the mode of procedure described in said step, it is possible for a sealing surface provided on the frame of the flat radiator likewise to be provided with a material that softens to such an extent that this sealing surface produces a sealing joint when the corresponding parts are brought into contact with one another. The discharge vessel can thereby be sealed automatically during the filling step. Specifically, the filling step serves the purpose of thinning the residual atmosphere in the discharge vessel as far as possible and filling it up with the desired discharge medium. In accordance with the teaching of this step, a function of the support elements in this case is firstly to hold up the top plate of the flat radiator over the frame so that an opening for filling the discharge vessel is kept free between the underside of the top plate and the top side of the frame. If, however, the abovenamed parts of the support elements soften sufficiently at an appropriate temperature, the top plate is lowered by the force of gravity, because these parts of the support elements are pressed flat. By virtue of the fact that the underside of the top plate comes to bear against the sealing surface on the frame, it is possible to implement a tight joint, and thus the desired inclusion of the discharge medium in the discharge vessel, and to implement the sealing of the latter.

In the cited prior art, it is argued, furthermore, that the fact that the softening parts of the support elements are pressed down together means that it is finally possible to achieve uniform loading of all the support elements.

In this case, use is frequently made, both for the sealing surface and for the softening parts of the support elements of solder glass materials or comparable substances. The disclosure content of the abovenamed document, which is incorporated by reference in this application, is referred to as regards the materials which can be used, the design of the support elements, the typical temperatures and the favorable viscosities of the various parts of the support elements.

SUMMARY OF THE INVENTION

Starting from said prior art, the present invention is based on the problem of specifying for a flat radiator that is designed for dielectrically impeded discharges a method of production that is improved with regard to the filling step.

The invention is based on a method of production for such a flat radiator in the case of which there are provided between the base plate and the top plate inside the frame a plurality of support elements of which, however, only some are used to hold up the plate during the filling step, the remaining support elements not being designed so as to soften during the filling step.

By contrast with the cited prior art, in the case of which all the support elements present are configured in the way described, the present invention proceeds from the fact that the number of the support elements used to hold up and lower the plate during the filling step, which must consequently have a softening part, should be as small as possible. This is because, firstly, the materials used for the softening part are frequently associated with unavoidable contaminants of the residual gas atmosphere in the discharge vessel which occur during the period of high temperature used for the lowering, and can also occur during the service life of the lamp, in particular at relatively high operating temperatures. Specifically, it is not possible to use arbitrarily high temperatures for the filling step. Consequently, for the softening parts use is frequently made of powdered glass held by organic binders (so-called solder glass), that already have a suitable viscosity at relatively low temperatures. The binder materials necessarily lead, however, to certain residual outgasings.

In precise terms, a distinction is to be made in this case between presintered parts, in the case of which only residues of the binder materials are still present, and merely preformed parts that still contain the complete binder. Instances of atmospheric contamination occur in both cases, but to a lesser extent with the presintered parts.

However, it is also possible to use materials without contamination problems, for example pure glass materials such as, for example SF6 glass. However, the invention also has additional advantages, nevertheless, when in this respect the described instances of contamination can already be avoided by means of the material used. Specifically, the low number of softening parts has the effect that the weight of the discharge vessel plate to be lowered is distributed over a correspondingly small number of softening parts. Consequently, the plates need to be weighted less, or no longer weighted at all, or it is also possible to tolerate higher viscosities.

Economizing on weights for weighting the discharge vessel plate to be lowered simplifies not only the method by virtue of the fact that these weights need to be applied no longer or only in lesser numbers. Rather, in the case of the corresponding heating steps it is also possible to achieve quicker changes in temperature and more homogenous temperature distributions. Moreover, the space available can be more effectively utilized. The number of the softening parts (or their dimensions or viscosities) can also in this case be used to adapt to the weight effectively available. This is advantageous when the flat radiator discharge vessels are heated in stacks. Then, the discharge vessels lying further below in the stack are loaded to a greater extent than those lying further up.

Furthermore, there can be cases in which specific geometries of the support elements are desired, for example contact surfaces that are extended as little as possible between the support elements and the corresponding plate in the form of edges or tips. The softening parts have a disturbing effect here, in that they widen the contact surface and/or block the discharge space in the immediate surroundings of this contact space. However, this discharge space is possibly required for reasons of the light distribution and/or the discharge distribution.

Moreover, the invention is not restricted to also undertaking, during the filling step, to seal the two plates with reference to one another or to a frame in the way described via solder glass materials or other softening materials. However, this mode of procedure constitutes a preferred variant. In this case, the contamination of the discharge medium by the softening material used for the purpose plays a lesser role because of the fact that the surface of this seal that is left exposed with reference to the discharge medium can be kept very small. The softening parts of the support elements necessarily have a certain volume, however, and therefore also a certain surface area. Finally, they are to permit a movement of the plate being held up over a macroscopic distance.

The invention is already implemented when only a subset of the plurality of support elements are used for holding up the plate, although it is preferred for at most half, even better at most a fifth, of this plurality to be designed therefore. At most four support elements should favourably be designed and used in this way. For example, these four support elements can be arranged in the four corners of a flat radiator discharge vessel in the shape of a rectangular plate, such that the plate to be held up is always supported in the region of its outer corners. Basically, however, three support elements also suffice to support a plate in a planar fashion. Finally, it is also possible to let the plate already rest on the frame at a corner of an edge, and otherwise still to hold it up with only two or even only one support element. In this case, the opening available for filling the discharge space is no longer open on all sides, but this need not necessarily constitute a problem. In particular, this opening can be designed to be somewhat higher than in the case of an all round opening and so an adequate cross section is available.

Starting from the prior art already cited, it was to be feared that with the mode of procedure proposed by this invention nonuniform loadings of the various support elements would occur that could lead to damage or instances of plate breakage. However, it has turned out surprisingly that the intrinsic elasticity of the materials used, in particular of flat glass plates, for example of the base plate, create here a compensation that is fully adequate in practice. This holds all the more when comparatively thin plate walls are used. Given a sufficiently large number of support elements, this will be aimed at in any case, as a rule.

The preferred design of the support elements consists of at least two parts of which the softening part is seated on the plate lying below during the filling step and bears the non-softening part. It is possible as a result, for example, for the contact surface between the upper part and the upper plate, which is preferably the top plate, to be kept small such that the emission of light is not much impaired.

However, a variant can also be favorable in which the part used to hold up the plate softens as a whole, in other words, thus, in which the element arranged between the top plate and the base plate softens as a whole. In this process, however, one of the two plates can be shaped such that the plate itself partly has the function of a support element. In any case, apart from the two plates and the softening support elements (parts of support elements) situated therebetween, in this variant there are no further separate non-softening parts of support elements (at least not at the points of the support elements used for holding up).

Two earlier patent applications by the same applicant, specifically DE 100 48 187.6 and DE 100 48 186.8, whose disclosure content is hereby incorporated, may be referred to in relation to the configuration of support elements integrated in the plates, in particular in the top plates. Specifically, the support elements can be constructed as unipartite components of the top plate, the outer contour of such supporting projections of the top plate tapering in the direction from the top plate to the base plate in at least one sectional plane perpendicular to the base plate. The top plate can already have been produced with these projections, suitable shaping methods being, for example, deep drawing or pressing. However, the projections can also be integrally formed subsequently. However, when the lamp is being mounted they are preferably present in one piece with the lamp, in order to avoid the outlay of positioning separate support elements. When the supporting projections at a few locations are constructed to be somewhat less deep or low, the softening parts can be interposed at these points. The outlay on positioning is restricted in this case, however, to the number of these points, which is relatively small in accordance with the invention.

Reference is made to the cited applications with regard to the advantageous effects of such integrated support elements on the homogeneity of the light distribution and the stability. Because of these particular advantages, the number of support elements is preferably comparatively large. In particular, it can be provided that the support elements are surrounded in each case by identical patterns of discharge structures, or vice versa that the discharge structures are each surrounded by identical patterns of support points. The present invention is of interest in such cases, because there the number of softening elements would be particularly large were the teaching of the already cited DE 198 17 478 to be followed.

As explained in the cited applications, it is also possible, in addition, for the supporting projections to run like ribs, that is to say to taper only in a one-dimensional fashion, as it were. However, it is preferred for them to taper in a second dimension as well, that is to say substantially run to a tip. It is then possible to provide the softening element with an opening into which the tip of an assigned supporting projection is inserted such that the top plate is mounted on these softening elements in a slightly self-adjusting fashion, or is in any event to be mounted relatively securely. The hollow spaces possible in this case in the softening elements should preferably be provided with an opening. The bounding surfaces of tube lengths can, for example, have cut-outs for this purpose. It is also possible for lateral holes to be provided. Moreover, tube lengths can be axially slit.

It is then preferred in the case of the supporting projections that are not to be used in conjunction with a softening part for holding up the plate to provide that the supporting projection and base plate bear against one another only by touching, and this is frequently sufficient to effect stabilization, in particular when the discharge medium is at a low pressure.

The preferred material for the softening elements consists, moreover, chiefly of SF6 glass. When the viscosity of the softening parts does not become very low, or is not intended to do so, or when the plate to be lowered is very light, then, as already mentioned, the plate being held up can also be weighted in order to assist the lowering operation.

DESCRIPTION OF THE DRAWINGS

The invention is explained in more detail below with the aid of an exemplary embodiment, it being possible for the features illustrated to be essential to the invention in other combinations, as well.

In detail, in the drawing:

Turning to FIG. 1, reference may be made firstly to the respective FIG. 3 of the two cited prior applications. For explanatory purposes, the same reference numbers are used in the present application if comparable elements are involved.

FIG. 1 shows a schematic plan view of a structure composed of a top plate (3 in FIGS. 2 and 3) and a base plate (4 in FIGS. 2 and 3) that correspond completely to the design of the cited applications except for the details explained below. The top plate 3 and the base plate 4 are, however, separated via tube lengths 15, made from SF6 glass, that are easily recognizable in FIG. 2 and illustrated in FIG. 1 from above in substantially circular cross section, and on which the outermost supporting projections rest in the corners of the rectangular format of the flat radiator. In this case, the supporting projections have a circular shoulder, denoted by 1, in the flat parts of the top plate 3 and extend from there, running conically to a tip, with a tip 2 at the lower end in the direction of the base plate 4. In this case, the tips 2 form the centers of the circles 1 when projected onto the planes of the plates. The top plate 3 is a deep drawn glass plate in this case, the top side of which has a contour largely corresponding to the underside. The supporting projections are relatively flat, the side walls illustrated in section in FIGS. 2 and 3 having in this section an angle of less than 40° relative to the base plate.

Figure 1:
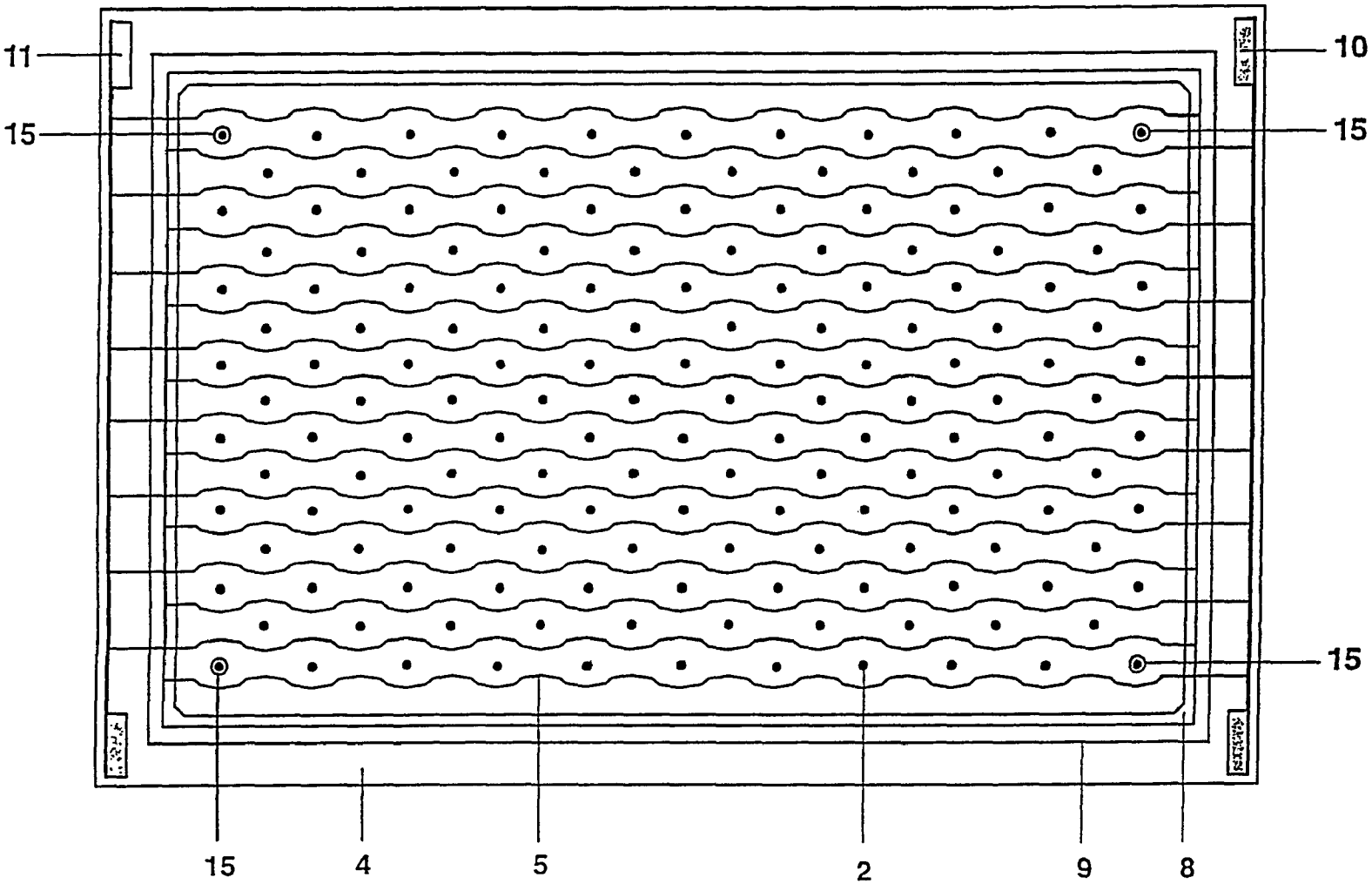
FIG. 1 shows a schematic plan view of a flat radiator discharge lamp according to the invention, with symbolized contact points between the support elements and the base plate and softening parts in the case of the support elements in the corners.

Designated by 5 in FIG. 1 are electrode strips that overall form a complete electrode set for dielectrically impeded discharges, both the anodes and the cathodes being dielectrically coated and also otherwise exhibiting no differences from one another. The electrode strips 5 are respectively fed alternately to a right-hand collective terminal 10 and a left-hand collective terminal 11, and can be connected to an electronic ballast thereby. Discharge regions form respectively in the most closely neighbouring sections of electrode strips 5 lying next to one another, such that they lie in the discharge space sections denoted by 6 in FIG. 3. Reference is made in addition for this purpose to the applications cited earlier. This also holds for the shape of the electrode strips, which is explained in more detail there. However, it emerges that the supporting projections are surrounded in each case by identical arrangements of most closely neighbouring discharge regions, and vice versa (except for edge regions), and that it is possible to draw through the arrangement illustrated in FIG. 1 lines along which discharge regions and supporting projections alternate. Reference is also made for this purpose to the prior applications. Moreover, for the sake of clarity the circular shoulders 1 are not illustrated in FIG. 1, and so the supporting projections are represented only by the tips 2.

In FIG. 1, the reference 8 indicates a frame-like structure that, in the case of this exemplary embodiment, forms not a separate frame but a likewise deep-drawn projection of the top plate 3. However, said projection is constructed as a rib and not as a cone running to a tip. The width of the frame rib 8 serves the purpose of a gas-tight connection in relation to the base plate 4 which can, as already explained, be produced by a solder glass. The line 9 lying further outside indicates the outer boundary of the frame, and therefore corresponds to a certain extent to the circular shoulder 1 in the case of the supporting projections. Reference is made to the prior applications in relation to further details of the lamp structure.

Figure 2:
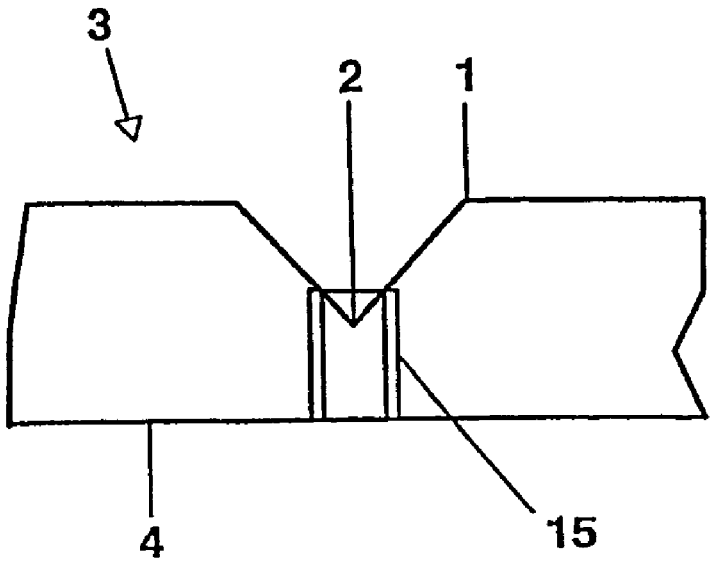
FIG. 2 shows a schematic side view of a support element from one of the corners in FIG. 1, before softening of the part provided for the purpose.
Figure 3:
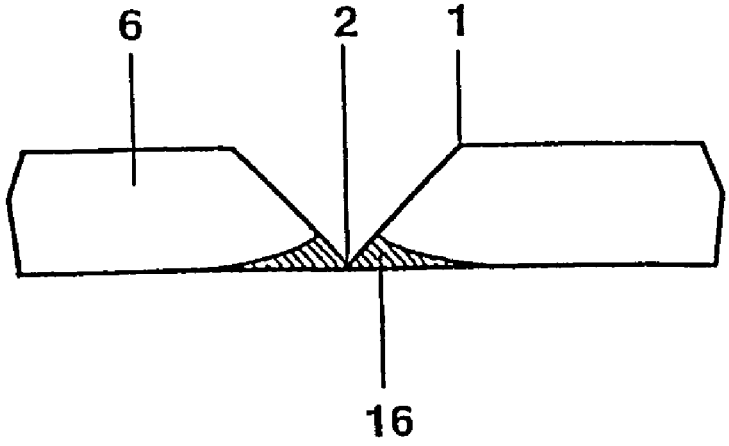
FIG. 3 shows a view corresponding to FIG. 2 after softening of this part.

When, before being sealed by gas-tight bonding or soldering of the frame 8 to the base plate 4, the lamp is to be evacuated and filled, it is "jacked up" in the state sketched in FIGS. 1 and 2, by mounting the outermost supporting projections at the corners on the tube lengths 15. In this case, the tubular projections 15 have a lateral slot, which is not illustrated in the drawing, so that their interior does not retain any contaminants during filling. During the filling step, the tube lengths 15 hold up the top plate 3 by approximately 2.5 mm in accordance with their vertical length, and so the entire discharge space can be flooded with the desired discharge medium. The vacuum furnace used therefor in the case of this example can then be heated up further until the softening temperature of the SF6 glass constituting the tube lengths 15 is reached, whereupon the tube lengths 15 are compressed by the weight of the top plate 3, which is weighted, if necessary, such that the situation illustrated in FIG. 3 is finally produced. Left over there from the tube length 15 of FIG. 2 is only an amorphously formed small heap of material 16 that additionally bonds the supporting projection 1, 2 on the base plate 4. Use should be made in this case of material quantities that are as small as possible, in order to impair as little as possible the optical functions, explained in the prior applications, of the supporting projections, including at the corners. These optical functions are, moreover, not much impaired, because the material 16 of the former tube length 15 is arranged in the lower region, that is to say near the base plate 4.

In the example illustrated, the tip 2 comes to bear against the base plate 4 in FIG. 3. This need not necessarily be so. The supporting projections 1, 2 designed for the softening tube lengths 15 can also have somewhat smaller vertical dimensions such that the tip 2 need not displace the material 16 entirely under itself, but because of the pointed shape this displacement does not form a particular obstacle. This could be otherwise in the case of rib-shaped supporting projections.

What is claimed is:

1. A method for producing a flat radiator designed for dielectrically impeded discharges which has:

a discharge vessel with a base plate (4), a top plate (3) and a frame (8, 9), connecting these, for holding a discharge medium in a discharge space, an electrode set (5) for generating dielectrically impeded discharges in the discharge medium, a dielectric layer between at least a part of the electrode set (5) and the discharge medium, and a plurality of support elements (1, 2, 15) that produce a connection between the top plate (3) and the base plate (4) inside the frame (8, 9), in the case of which method one of the plates (3) is held up by at least one of the support elements (1, 2, 15) during a filling step preceding a closure of the discharge space, which support element is partially softened (15, 16) by the application of heat in order to close the discharge space, as a result of which the plate (3) being held up is lowered, characterized in that only same of the plurality of support elements (1, 2, 15) are used to hold up the plate (3), and the remaining support elements (1, 2) of the plurality of support elements do not soften during the filling step.

2. The method as claimed in claim 1, in which at most half the plurality of support elements (1, 2, 15) are used to hold up the plate (3) and soften (15, 16) during the filling step.

3. The method as claimed in claim 2, in which at most four of the plurality of support elements (1, 2, 15) are used to hold up the plate (3) and soften during the filling step.

4. The method as claimed in claim 1, in which the support elements (1, 2, 15) used for holding up the plates comprise a part (1, 2) not softening during the filling step and a part (15) softening during this step, the softening part (15) being arranged between the non-softening part (1, 2) and the plate (4) lying below during the filling step.

5. The method as claimed in claim 4, in which the plate (3) held up during the filling step is the top plate.

6. The method as claimed in claim 1, in which the softening parts (15) of the support elements (1, 2, 15) used to hold up the plate (3) lie directly between the top plate (3) and the base plate (4).

7. The method as claimed in claim 6, in which the support elements (1, 2) are supporting projections constructed as unipartite components of the top plate (3) and in each case have an element (15) that is arranged between the respective supporting projection (1, 2) and the base plate (1) and softens during the filling step.

8. The method as claimed in claim 7, in which the outer contour of the supporting projections (1, 2) tapers in the direction from the top plate (3) to the base plate (4) in at least one sectional plane perpendicular to the base plate.

9. A method as claimed in claim 8, in which the tapering shape of the supporting projections (1, 2) runs to a tip, and the element (15) softening during the filling step has an edge and an opening surrounded at least substantially by the edge, the tip (2) of the respective supporting projection being inserted into the opening, and the edge supporting the supporting projection.

10. The method as claimed in claim 1, in which the elements (15), softening during the filling step, of the supporting elements (1, 2, 15) have a hollow shape with a pump opening.

11. The method as claimed in claim 1, in which the elements (15), softening during the filling step, of the supporting elements (1, 2, 15) consist essentially of SF6 glass.

12. The method as claimed in claim 1, in which the plate (3) being held up is additionally weighted in order to assist the lowering operation.

* * * * *